United States Patent [19]

Parker

[11] 4,241,949

[45] Dec. 30, 1980

[54] ROCKABLE FURNITURE

[76] Inventor: Michael S. Parker, Box 200, Sorrento, Me. 04677

[21] Appl. No.: 943,961

[22] Filed: Sep. 20, 1978

[51] Int. Cl.[3] ..... A47C 3/029

[52] U.S. Cl. ..... 297/3; 297/258

[58] Field of Search ..... 297/1, 2, 3, 258, 270; D6/3, 49; 272/56.5 R, 55; D34/5 D

[56] References Cited

U.S. PATENT DOCUMENTS

| | | | |
|---|---|---|---|
| 1,441,940 | 1/1923 | Nafe | 297/2 X |
| 1,729,941 | 10/1929 | Hocking et al. | 297/1 |
| 2,269,834 | 1/1942 | Wagner | 297/2 |
| 2,622,658 | 12/1952 | Morgan | 297/2 X |
| 2,776,700 | 1/1957 | Potter et al. | 297/3 |
| 3,099,477 | 7/1963 | O'Herron | 297/1 |
| 3,526,429 | 9/1970 | Metzger | 297/258 |

*Primary Examiner*—Francis K. Zugel

*Attorney, Agent, or Firm*—E. Seward Stevens

[57] ABSTRACT

The invention comprises rockable piece of furniture comprising side pieces, the bottom edges being irregular curves serving as rockers, a seat located therebetween, plus a back comprising a step and slide section, the side piece rockers being provided with ears to limit the rocking action, said side pieces being shaped at the top to accommodate the arms and hands of an occupant.

5 Claims, 4 Drawing Figures

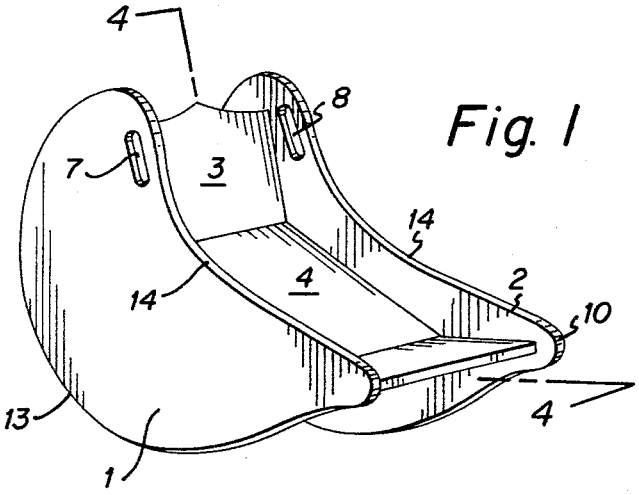
Fig. 1
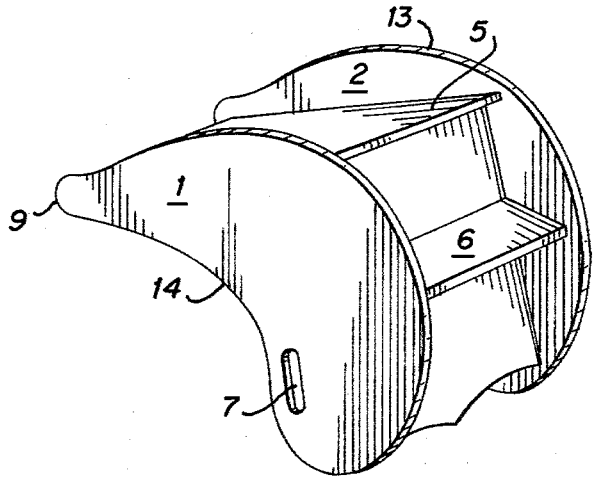
Fig. 2
Fig. 3
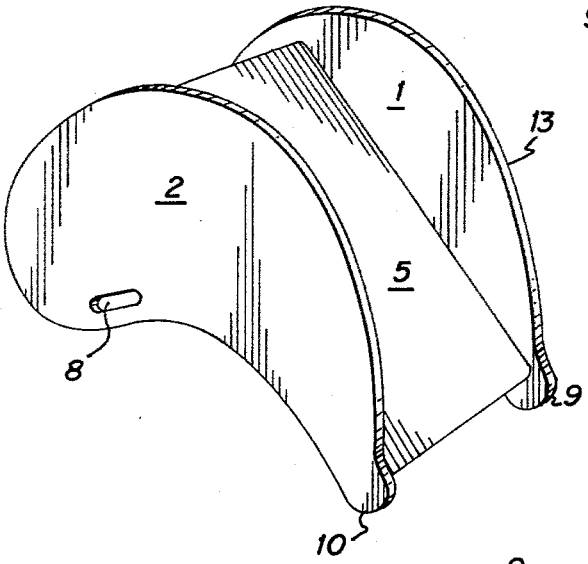
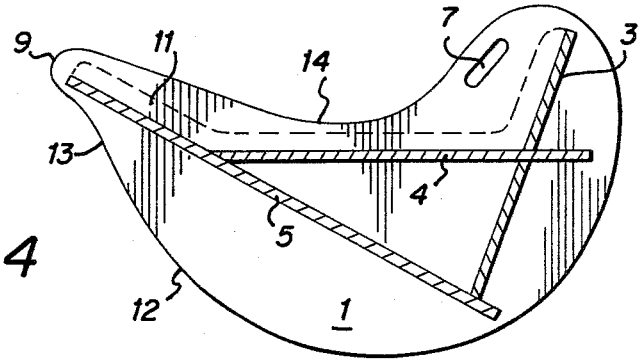
Fig. 4

ROCKABLE FURNITURE

The object of the invention is to provide an article of furniture so structured as to suit an occupant of any size and to permit a rocking action of approximately 125° but limited to prevent overbalancing. By turning the article over, to rest same on the top of the side pieces it provides a slide and an access step for so using same. It may also be placed on its side to serve as a table.

Another object is to provide an article of the character described in which the curve of the bottom edges of the side pieces is precisely constructed to accommodate occupants of different weights without other adjustment and to permit rocking action through an arc of about 125°.

Another object is to provide an article of the character described in which, in rocking position, a seat section is provided with a back angled therefrom at a predetermined angle and from a slide section at about right angles.

Another object is to provide an article designed to serve as a therapeutic device for children in the development stage of motor skills and is also useable by adults who may have a motor handicap.

A further object is to provide an article of the character described in which the above and other objects may effectively be attained by a structure of precise but simple design which lends itself to safe and pleasant use.

The shape of the body support is very important because it accommodates a seat, long back rest and a head rest that also make into a slide and step. These, incombination with the foam cusion, bring the occupant to a balance point with the back and head rest level with the top arc. This combination gives the graceful and secure rock that only this design can give. The placement and shape of the body support piece, together with the depth of the cushion is imperative in achieving a 125° rock.

The chair is so designed that no matter the size of the individual, the same balance point can be reached.

All the other patent designs incorporate a half-circle, using a single radius for the bottom curve. The rockers of the invention are made up of arcs of at least three different radii.

The rocker front curve is so designed to give a fast sweeping backward motion. The longer radius in the bottom middle section begins to slow the chair down and the elongated curve in the far back of the rocker gives the full, but secure, 125° rock to the ears or stops. The second and third curves tend to slow the occupant gradually from the full sweep of the front curve; therefore slowing the individual down before going to its maximum rock. More effort is required as the individual rocks farther back.

The combination of the bottom curves together with the positioning and shape of the body support is essential for the object to achieve its unique 125° rock.

A practical embodiment of the invention is shown in the accompanying drawing in which, except for FIG. 4, the cushion is not shown.

FIG. 1 represents a top perspective of the invention in rockable position.

FIG. 2 represents a bottom perspective of the embodiment shown in FIG. 1 in position to be used as a slide.

FIG. 3 represents a view in perspective of the opposite side of that shown in FIG. 2; and FIG. 4 represents a longitudinal vertical section taken on the line IV—IV of FIG. 1 looking in the direction of the arrows.

Referring to the several views in which the parts bear the same numerals in each view, the curved side pieces are denoted by 1 and 2. Said pieces terminate in ears 9 and 10, the function of which is set forth below. Spacing said sides and secured thereto by glue or other well known means are the seat 3 and back 4, plus the slide 5.

As shown in FIG. 2, a step 6 is located on back 4 to give access to slide 5 when it is desired to use same.

Hand holes 7, 8 are cut out from sides 1 and 2 and may be located in positions other than shown without interfering with the use of the device as a "rocker" or "slide".

Experience has shown that close adherence to certain arcs of rocker (the bottom edge of each sidepiece) and other dimensions are critical to the precise balance necessary for satisfactory use of this invention.

For example, in one size, it being understood several sizes are feasible if the proper sidepiece bottom arc and other dimensions are correctly proportioned, a small rocker will be 33" in overall length and 20¼" high at its highest point.

An important factor of the seat is the positioning of the back rest and its height from the floor which, in this size, must be 21" measured to the top of a cushion 11 (shown in dotted outline in FIG. 4 but not forming a part of the invention as same functions without it.

The bottom curve of each side piece 1,2 on which the device rocks is critical to satisfactory operation, same being a combination of curves or an irregular curve 12 and blended into the reverse curve 13 of the ears 9 and 10 which prevent the device from overturning when said ears contact the floor at the backward limit of rock (about 125°).

The ears 9,10 also provide part of the support when the article is turned to function as a slide 5.

The width of the device is not critical, but the top curve 14 of the upper section of the sides is important to the comfort of the user's arms and to enable a good grasp of the hand holes 7,8.

It should be noted that the weight of an occupant does not affect the operation of the device and if a larger model is desired the described proportions of measurement, arc and location of the several elements must be maintained in each for satisfactory operation.

While wood is preferred for constructing the device any well known or approved material may be used. Also the device may be ventilated by cut outs or different hand holes used without departing from the spirit and scope of the invention. Therefore, I do not intend to be limited to the exact embodiment shown and described except as set forth in the appended claims.

I claim:

1. A rockable device comprising vertical supports, the bottom of each support being formed of identical irregular curves made up of arcs of at least three different radii, the radius of the arc at one end being greater than the remaining arc radii, the greater radius arc of each said support bottom blending into a reverse curve section at one end thereof, means fastened to and spacing said supports, said last named means comprising a horizontal back section, a seat section angled upwardly therefrom at one end of the back section, and a slide angled from the opposite end of the back section whereby the device may be occupied and rocked through an arc of more than 120°, or alternatively turned over for use as a slide.

2. A device according to claim 1 in which the slide is connected to the bottom of the seat section.

3. A device according to claim 1 in which both the tops and bottoms of said supports are curved to accommodate the arms of a user and effect the rocking action respectively.

4. A device according to claim 1 in which each support is provided with a hand hole adjacent said seat section each hand hole being located over the rocker section having the smaller radius.

5. A device according to claim 1 in which the horizontal back section is provided with an end section comprising a step behind the seat section.

* * * * *